US009051088B2

(12) United States Patent
Chisholm

(10) Patent No.: US 9,051,088 B2
(45) Date of Patent: Jun. 9, 2015

(54) VACUUM RELEASE SEAL FOR A CLOSURE AND CONTAINER PACKAGE

(71) Applicant: Owens-Brockway Glass Container Inc., Perrysburg, OH (US)

(72) Inventor: Brian J. Chisholm, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 90 days.

(21) Appl. No.: 13/835,014

(22) Filed: Mar. 15, 2013

(65) Prior Publication Data

US 2014/0263321 A1 Sep. 18, 2014

(51) Int. Cl.

| | |
|---|---|
| ***B65B 7/28*** | (2006.01) |
| ***B65D 45/02*** | (2006.01) |
| ***B65D 45/30*** | (2006.01) |
| ***B65D 51/14*** | (2006.01) |
| ***B65D 51/16*** | (2006.01) |
| ***B65D 53/02*** | (2006.01) |

(52) U.S. Cl.

CPC ..... *B65D 45/02* (2013.01); *B65D 45/305* (2013.01); *B65D 51/145* (2013.01); *B65D 51/1688* (2013.01); *B65D 53/02* (2013.01)

(58) Field of Classification Search

CPC ..... B65D 41/28; B65D 51/145; B65D 43/305

USPC ..... 215/270, 228, 274, 276, 262, 352

See application file for complete search history.

(56) References Cited

U.S. PATENT DOCUMENTS

| | | | | |
|---|---|---|---|---|
| 2,244,316 | A * | 6/1941 | Robertson | 215/262 |
| 3,052,478 | A * | 9/1962 | Horvereid | 277/394 |
| 3,227,302 | A | 1/1966 | Merrill | |
| 3,603,472 | A * | 9/1971 | Lecinski et al. | 215/253 |
| 3,924,772 | A * | 12/1975 | Magnani | 215/276 |
| 5,551,705 | A * | 9/1996 | Chen et al. | 277/648 |
| 5,697,513 | A * | 12/1997 | Molodyi | 220/320 |
| 6,276,543 | B1 | 8/2001 | German et al. | |
| 6,662,958 | B2 | 12/2003 | German et al. | |
| 7,690,527 | B2 * | 4/2010 | Englund | 220/304 |
| 7,861,874 | B2 | 1/2011 | Cook et al. | |
| 8,550,268 | B1 * | 10/2013 | Chisholm | 215/44 |
| 2007/0262041 | A1 | 11/2007 | Smith | |
| 2010/0126304 | A1 * | 5/2010 | Sahm et al. | 74/606 R |
| 2010/0140881 | A1 * | 6/2010 | Matsuo | 277/648 |
| 2011/0193298 | A1 * | 8/2011 | Yoshitsune et al. | 277/648 |
| 2012/0037587 | A1 | 2/2012 | Tirosh | |

OTHER PUBLICATIONS

PCT Int. Search Report and Written Opinion, Int. Serial No. PCT/US2014/020970, Int. Filing Date: Mar. 6, 2014, Applicant: Owens-Brockway Glass Container Inc., Mail Date: May 28, 2014.

* cited by examiner

*Primary Examiner* — Steven A. Reynolds
*Assistant Examiner* — King M Chu

(57) ABSTRACT

A seal for sealing engagement between a closure and a container. A seal ring has a sealing portion. A projection is coupled to the seal ring, extends circumferentially and radially outwardly of the seal ring, and has a closure-driven feature engageable by the closure when the closure is rotated on the container in a loosening direction to unseat the seal ring from sealing engagement between the container and the closure. The seal may be part of a package and sealingly engaged between a sealing surface of a container of the package and a base of a closure of the package when the closure is secured to the container.

34 Claims, 8 Drawing Sheets

VACUUM RELEASE SEAL FOR A CLOSURE AND CONTAINER PACKAGE

The present disclosure relates to closures and, more particularly, to container closures applied to containers under vacuum.

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads to cooperate with corresponding features of the closure, and a circular end surface to cooperate with a seal on an undersurface of the closure. U.S. Pat. No. 2,244,316 illustrates a glass container and closure of this type.

A general object of the present disclosure is to provide a seal for a closure and container package that has a feature to release vacuum in the package, wherein the closure can be resealed to the container after use of the vacuum release feature, and wherein the package is readily suited for elevated temperature applications such as hot-fill and retort applications.

The present disclosure embodies a number of aspects that can be implemented separately from or in combination with each other.

A seal for sealing engagement between a closure and a container, in accordance with one aspect of the present disclosure includes a seal ring having a sealing portion, and a projection being coupled to the seal ring, extending circumferentially and radially outwardly of the seal ring, and having a closure-driven feature engageable by the closure when the closure is rotated on the container in a loosening direction to unseat the seal ring from sealing engagement between the container and the closure.

In accordance with another aspect of the present disclosure, a closure and a container package includes a container having a finish with at least one closure securement element and an annular axially facing sealing surface, and a closure that includes a base with a cylindrical wall and at least one container securement element on the cylindrical wall for engaging the at least one closure securement element on the finish. The package also includes an annular seal ring disposed between the base and the sealing surface for sealing engagement with the base and the sealing surface upon threaded tightening of the closure onto the finish. The package is characterized in that an annular support ring is disposed adjacent to the seal ring, the support ring having a circumferentially facing closure abutment, and the closure includes an internal lug to engage the closure abutment on the support ring upon rotation of the closure on the finish in an unthreading direction to rotate the support ring and stretch portions of the seal ring out of sealing engagement with the sealing surface and/or the base.

In accordance with a further aspect of the present disclosure, a closure and a container package that includes a container having a finish with at least one closure securement element and an annular axially facing sealing surface, and a closure that includes a base with a cylindrical wall and at least one container securement element on the cylindrical wall for engaging the at least one closure securement element on the finish. The package also includes an annular seal ring disposed between the base and the sealing surface for sealing engagement with the base and the sealing surface upon threaded tightening of the closure onto the finish. The package is characterized in that an annular support ring is disposed adjacent to the seal ring, the support ring having a radially outwardly facing cam, and the closure includes an internal lug to engage the cam on the support ring upon rotation of the closure on the finish in an unthreading direction to push the cam and the seal ring radially inwardly out of sealing engagement with the sealing surface and/or the base.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
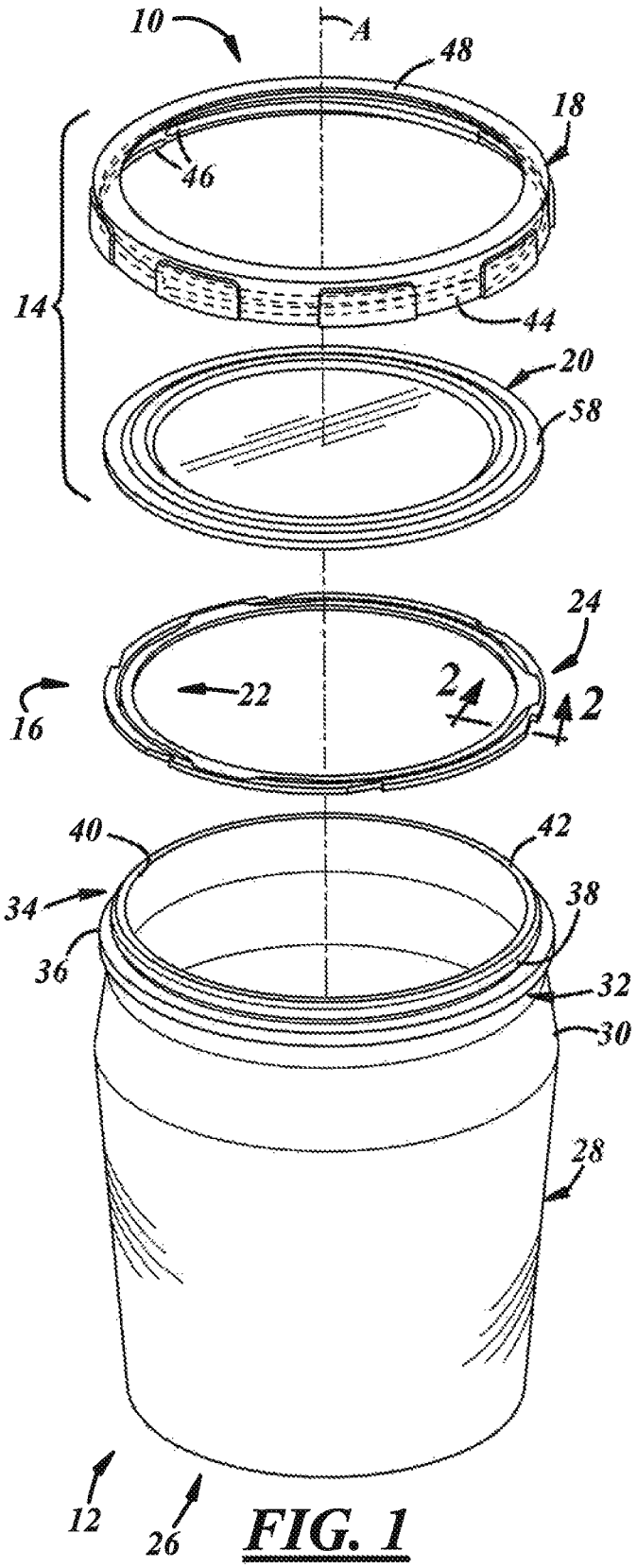
FIG. 1 is an exploded perspective view of a package in accordance with an illustrative embodiment of the present disclosure, and including a container, a closure for the container, and a seal for sealing the closure to the container.

FIG. 1 illustrates a package 10 including a container 12, a closure 14 coupled to the container 12 for closing the container 12, and a seal 16 between the container 12 and the closure 14 for sealing the closure 14 to the container 12. The container 12 may be a single, integral, article of manufacture.

The closure 14 may be a multiple piece closure, which may include an annular closure ring or skirt 18 for coupling to the container 12 and a separate closure base 20 disposed between the skirt 18 and the container 12 for closing the container 12. The seal 16 may be a multiple piece seal, which may include a seal ring 22 and a projection 24 coupled to the seal ring 22. Like the seal ring 22, the projection 24 may be a carrier or support that may be annular, for example a ring, to circumferentially support the seal ring 22. In the illustrated embodiment, the projection 24 may have a radially outer periphery greater in radial dimension than a corresponding radially outer periphery of the seal ring 22. In any event, those of ordinary skill in the art will recognize that the projection 24 has a longitudinally cross-sectional centroid that is radially outboard of a longitudinally cross-sectional centroid of the seal ring 22. As will be described in further detail herein below, upon rotation of the closure 14 on the container 12 in a loosening direction, the projection 24 is engageable by a portion of the closure 14 to unseat the seal ring 22 from sealing engagement between the container 12 and the closure 14 and thereby release vacuum from within the package 10.

The package 10 may be used to package pickles, baby food, salsa, peppers, spaghetti sauces, jams, or any other hot-fill food product(s). The package 10 also may be used to package other types of products including but not limited to liquids, gels, powders, particles, and the like. The package 10 may be suitable for hot-fill applications of product at 185° F. and above, and can be developed for retort applications at temperatures of 260° F. and above. The package 10 includes a longitudinal axis A, about which the closure 14 may be rotated with respect to the container 12.

The container 12 may be composed of glass, or any other material suitable for containing food products. The container 12 includes a base 26, and a body 28 extending from the base 26, and also may include a shoulder 30 extending from the body 28. In other embodiments, however, the container body 26 need not include the shoulder 30. In any event, the container 12 also may include a neck 32 extending from the shoulder 30 (or directly from the body 28). The neck 32 includes a neck finish 34 that may include a capping flange 36, and one or more external, or radially outwardly extending, closure securement elements 38 that may include lugs, bayonets, thread segments, or any other suitable features. As used herein, the phrase "thread segment" includes whole, partial, multiple, and/or an interrupted thread and/or thread segment. The closure securement elements 38 may include two, three, four, or any other suitable quantity of elements. In any case, the elements 38 collectively may extend completely circumferentially around the neck finish 34. The neck finish 34 also includes an open mouth 40 surrounded by a sealing surface 42 of the neck finish 34. The sealing surface 42 faces axially for engagement with a corresponding portion of the closure 14.

Figure 2:
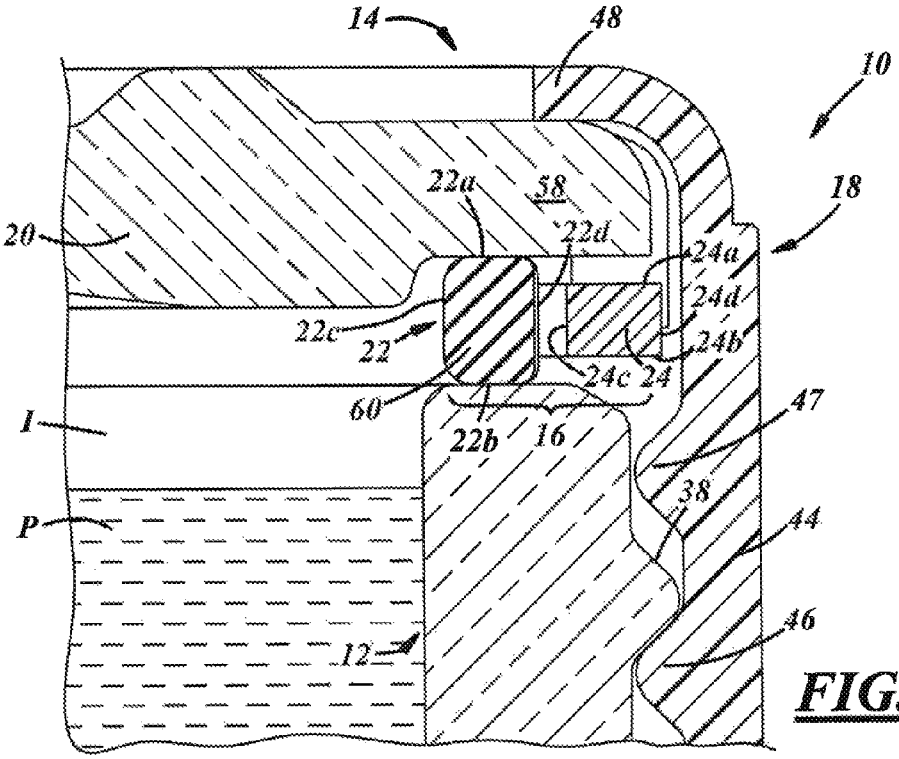
FIG. 2 is a fragmentary sectional view of the package of FIG. 1, illustrating the package in an assembled and sealed condition.

With reference to FIG. 2, the closure 14 may be of multiple-piece construction as illustrated, or of integral one-piece construction. Also, the closure 14 may be provided in any suitable sizes, and may be a wide-mouth type of closure when the container 12 is a wide-mouth type of container. The components of the closure 14 may be composed of metal, plastic, glass, ceramic, and/or any other material(s) suitable for use with food products. The container 12, with the closure 14 sealingly coupled thereto, establishes a package interior I and may hold a product P within the package 10, for instance, under vacuum.

The skirt 18 has a cylindrical wall 44 with one or more internal, or radially inwardly extending, container securement elements 46 for engagement with the external securement feature(s) 38 on the finish 34. The skirt 18 also has a radially inwardly directed flange 48, at an upper end of the wall 44. The skirt 18 further has a radially inwardly directed seal retainer 47 between the securement elements 46 and the flange 48 to retain the seal 16 to the skirt 18. The skirt 18 may be composed of plastic.

The base 20 may be a disc or plate of glass, and may extend in a generally radial direction. The base 20 has a periphery 58, preferably planar and circular, that is captured between the flange 48 and the container 12 and, more particularly, between the flange 48 and the seal 16. A central portion of the base 20 can be of any suitable geometry, with a generally flat planar geometry being illustrated in the drawings.

The seal 16 is carried within the cylindrical wall 44 of the closure skirt 18 and against the periphery 58 of the base 20. The seal ring 22 includes a sealing portion 60 disposed for sealing engagement with the sealing surface 42 of the container 12 and with an undersurface of the closure base 20. In longitudinal cross section in the embodiment illustrated in FIG. 2, the seal ring 22 may be rectangular with shorter axial facing surfaces 22*a*, 22*b* and longer radially facing surfaces 22*c*, 22*d*. In other embodiments, the seal ring 22 may be round, oval, or of any other suitable geometry in cross section.

The projection 24 may have portions disposed radially outwardly of the sealing portion 60 of the seal ring 22. In longitudinal cross section, the projection 24 may be rectangular and may have axial facing surfaces 24*a*, 24*b* and radially facing surfaces 24*c*, 24*d*, and may be of axial height that is shorter than that of the seal ring 22. Radial gaps may be present between the sealing portion 60 and the projection 24.

Figure 3:
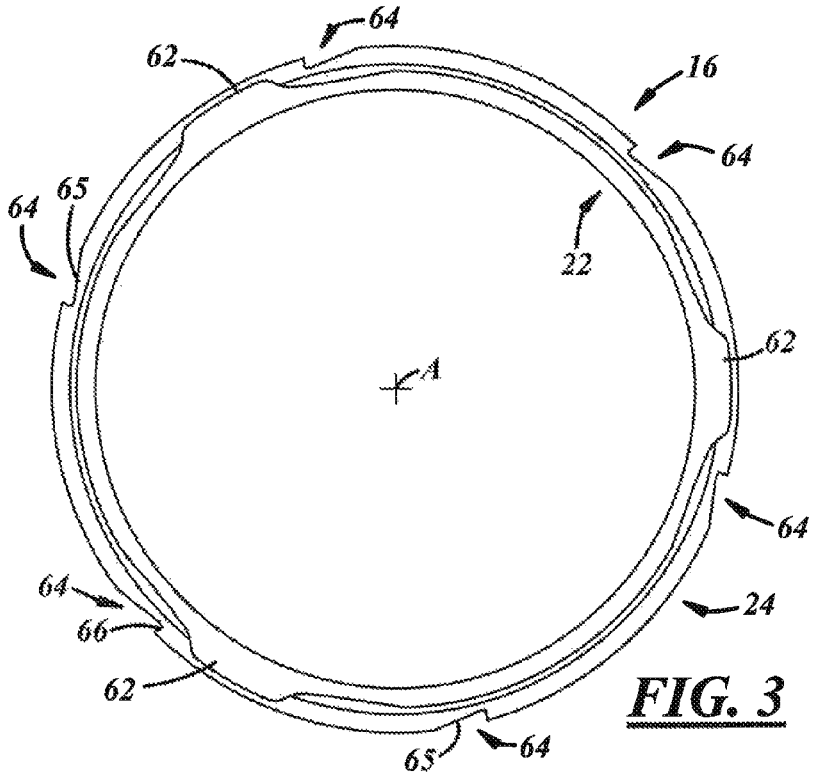
FIG. 3 is a top view of the seal of FIG. 1.

With reference to FIG. 3, the seal ring 22 also may include one or more support attachment portions 62 fixed to the projection 24. In the illustrated example, there are three such portions 62 but any suitable quantity may be used. The support portions 62 may be fixed to the projection 24 by integral molding, adhesive, welding, mechanically using interlocking tabs, slots, pins, holes, or other fasteners, or in any other suitable manner. In one particular example, the seal ring 22 may be overmolded and/or insert molded to the projection 24. In any case, the seal ring 22 may not fixed to the projection 24 over the full 360 degree circumference of the seal 16. Rather, preferably there are portions therebetween that are unattached to allow the seal ring 22 to stretch. Also, the seal ring 22 may be thinner in some portions thereof than in others to facilitate such stretching or necking.

The projection 24 may include an inside diameter, which may be circumferentially continuous, and an outside diameter, which may be circumferentially interrupted with closure-driven features 64 for cooperating with the closure 14. The closure-driven features 64 may be cam followers or ratchet features, which may include ramps 65 that may face tangentially outward and abutments 66 that may face circumferentially.

Figure 4A:
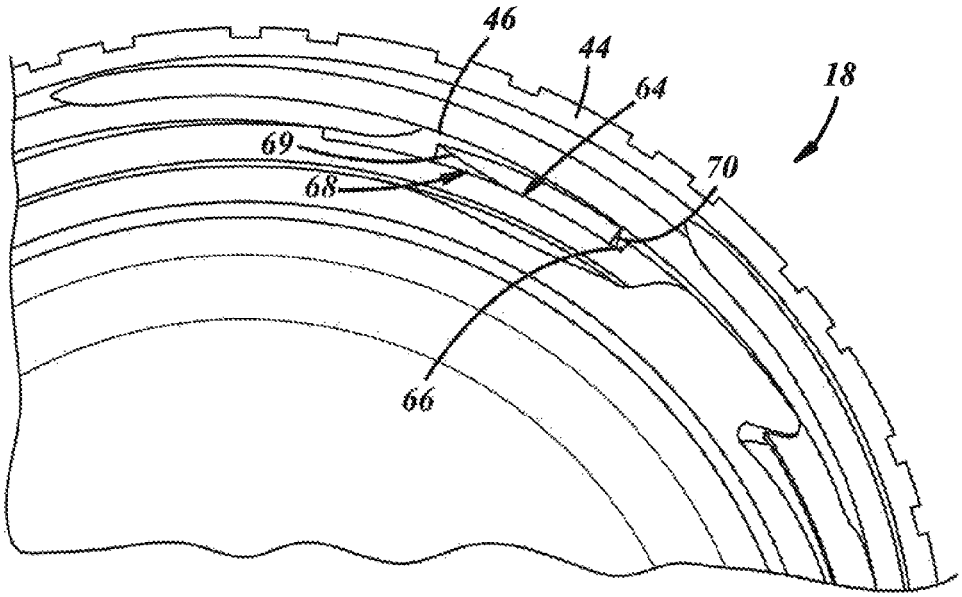
FIG. 4A is a fragmentary bottom view of the seal and closure of FIG. 1 assembled together.
Figure 4B:
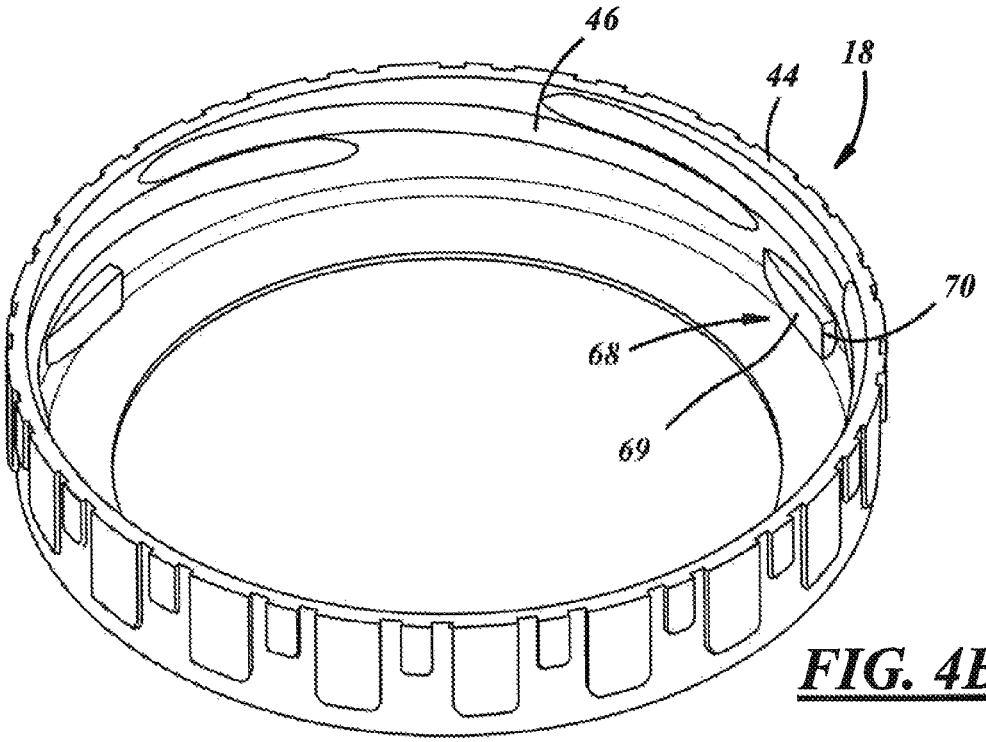
FIG. 4B is a bottom perspective view of the closure of FIG. 1.
Figure 4C:
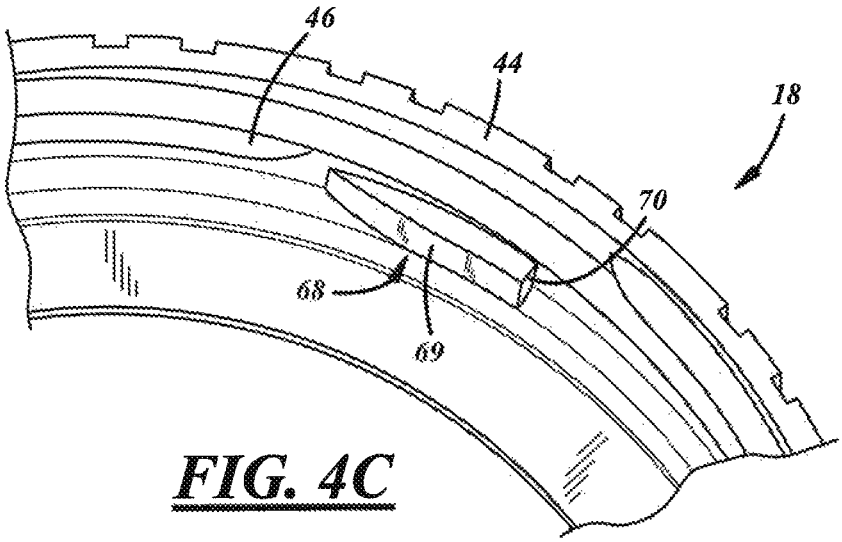
FIG. 4C is an enlarged, fragmentary, bottom perspective view of a portion of the closure of FIG. 1.

With reference to FIGS. 4A, 4B, and 4C, the closure skirt 18 may include one or more seal drive features 68 for cooperation with the closure-driven features 64 of the projection 24 (FIG. 4A). The seal drive features 68 may be cams or lugs and may extend radially inwardly from the cylindrical wall 44 of the skirt 18 in a location between the container securement elements 46 and the flange (not shown). The quantity of the seal drive features 68 may correspond to the quantity of the closure-driven features 64 (FIG. 4A). The seal drive features 68 may include ramps 69 that may face tangentially inward and abutments 70 that may face circumferentially for engagement with the abutments 66 of the seal closure-driven features 64 (FIG. 4A).

With reference to FIG. 4A, when the closure 14 and the seal 16 are rotatingly applied or tightened to the container 12

(FIG. 2), the ramps 69 of the seal drive features 68 may ride over the ramps 65 of the closure-driven features 64 and may cause the projection 24 to deflect radially inwardly somewhat, but not enough to detrimentally affect sealing when the closure 14 is tightened to a final sealed position. But when the closure 14 is being rotatingly removed or loosened from the container 12, the abutments 70 of the seal drive features 68 circumferentially engage the corresponding abutments 66 of the projection 24. Such engagement causes rotation of the projection 24 relative to the container 12 (FIG. 5) and, consequently, causes the seal ring 22 to be pulled circumferentially at the attachment portions and, consequently, causes stretching of the sealing portion 60 of the seal ring 22 between the attachment portions 62.

Figure 5:
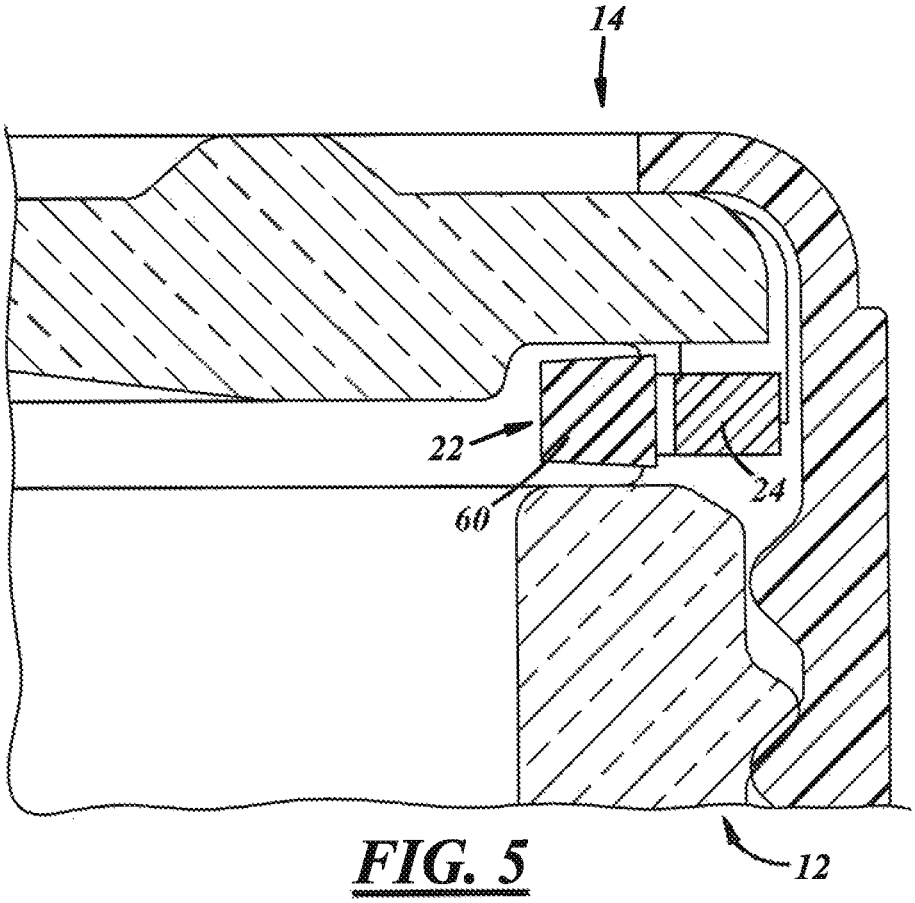
FIG. 5 is a fragmentary sectional view of the package of FIG. 1, illustrating the package in a vented condition.

In turn, and with reference to FIG. 5, such stretching causes deformation of one or more parts of the sealing portion 60 sufficient to reduce the height of those parts. Accordingly, the sealing portion 60 disengages from the container 12 and/or the closure 14 and establishes at least one vacuum release path axially therebetween, as indicated by the spaces between the sealing portion 60 and the container 12 and the closure 14. But because the seal ring 22 is elastic, it may return to an unstretched state and may be resealed to the container 12 for subsequent uses.

Figure 7:
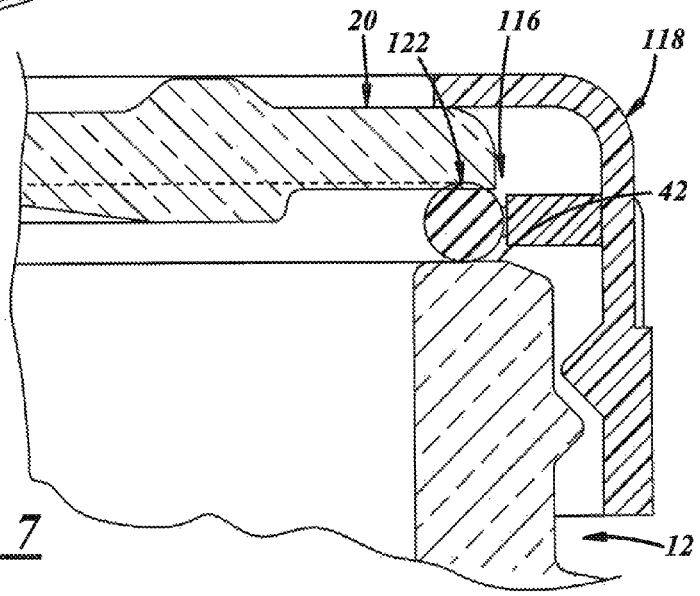
FIG. 7 is a fragmentary sectional view of the container and seal of FIG. 6 with the closure applied to the container and seal and shown in the sealed mode.
Figure 8:
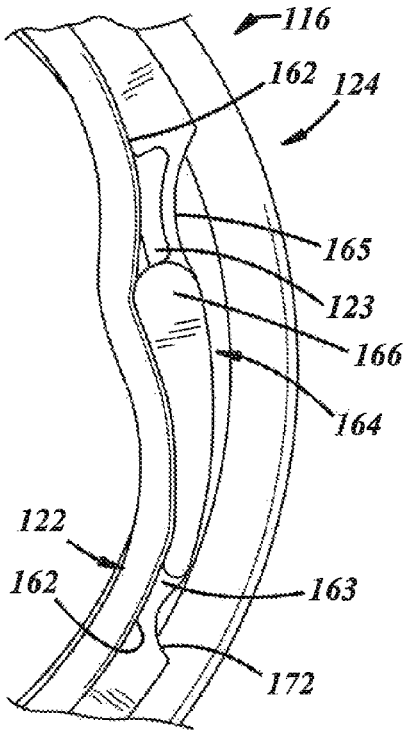
FIG. 8 is a top view of a portion of a package in accordance with another illustrative embodiment of the present disclosure, and including the seal of FIG. 6 illustrated on top of a sealing surface of a container with a closure removed for clarity and in a vented mode.
Figure 9A:
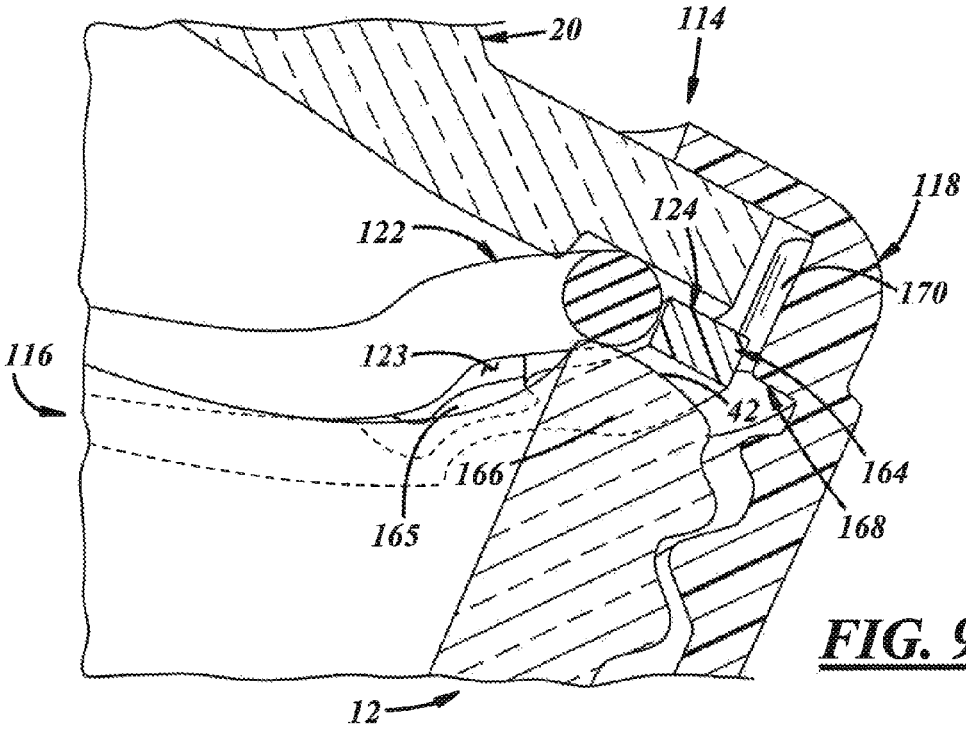
FIG. 9A is a fragmentary, perspective, sectional view of the container and seal of FIG. 8 with the closure applied to the container and seal and shown in the vented mode.

FIGS. 6-9B show another illustrative embodiment of a seal 116 and a closure 114 (FIG. 9A). This embodiment is similar in many respects to the embodiment of FIGS. 1-5 and like numerals among the embodiments generally designate like or corresponding elements throughout the several views of the drawing figures. Accordingly, the descriptions of the embodiments are incorporated into one another, and description of subject matter common to the embodiments generally may not be repeated here.

Figure 6:
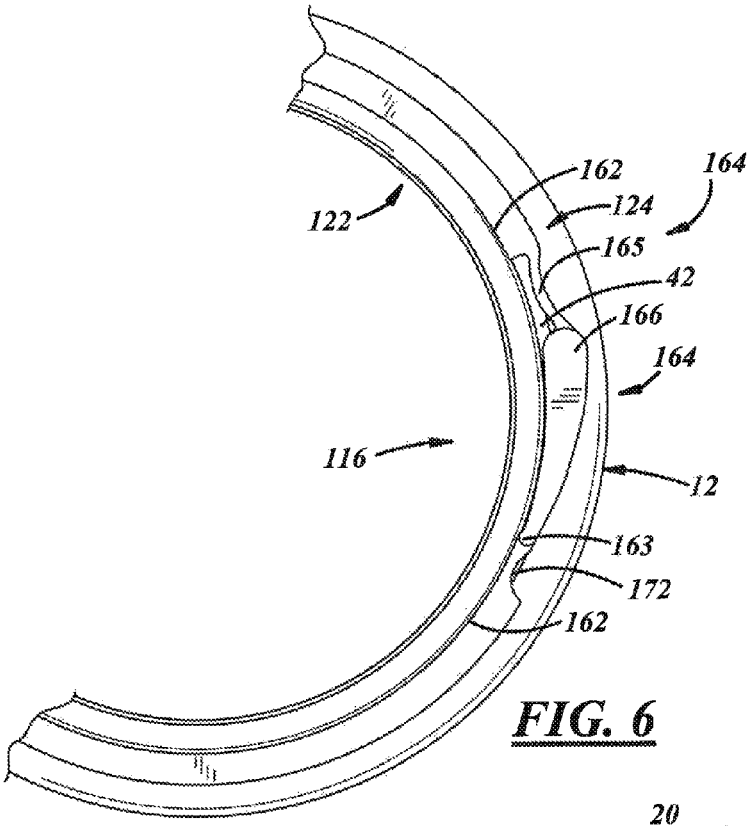
FIG. 6 is a top view of a seal in accordance with another illustrative embodiment of the present disclosure, and illustrated on top of a sealing surface of a container with a closure removed for clarity and in a sealed mode.

FIG. 6 illustrates the seal 116 including a seal ring 122 and a projection 124 coupled to the seal ring 122. Like the seal ring 122, the projection 124 may be an annular carrier or support ring to circumferentially support the seal ring 122, and, in any case, has a radially outer periphery greater in radial dimension than a corresponding radially outer periphery of the seal ring 122. The seal ring 122 may include inner and outer diametric surfaces that may be completely circumferentially continuous. The projection 124 may include inner and outer diametric surfaces that may be circumferentially continuous, except for portions that will be described herein below. The seal ring 122 may be circular in longitudinal cross section, and the projection 124 may be rectangular in longitudinal cross section, but the cross section of the seal ring 122 and the projection 124 may be of any suitable geometry. The seal ring 122 may be coupled to the projection 124 at least at attachment points 162 and, preferably, circumferentially around the seal 116 except for a circumferential portion generally corresponding to a closure-driven feature 164 between the attachment points 162. Although only one closure-driven feature 164 is illustrated, it is contemplated that any suitable quantity may be used.

With reference to FIG. 7, those of ordinary skill in the art will recognize that the projection 124 has a longitudinally cross-sectional centroid that is radially outboard of a longitudinally cross-sectional centroid of the seal ring 122. Also, the projection 124 may be axially shorter than the seal ring 122.

With reference to FIG. 8, the closure-driven feature 164 may include a fulcrum end 163 coupled to a corresponding portion of the projection 124, for example, at a location circumferentially adjacent one of the attachment points 162. The closure-driven feature 164 also may include a closure engagement end 166 circumferentially and radially spaced from the fulcrum end 163. The closure-driven feature 164 may extend circumferentially along and radially away from the seal ring 122 such that a radial and circumferential space is formed therebetween. The closure-driven feature 164 may be a circumferentially extending beam of excurvate shape.

As also shown in FIG. 8, the projection 124 also includes a leaf spring 165 having a first end coupled to a corresponding portion of the projection 124, for example, at a location circumferentially adjacent another one of the attachment points 162. The leaf spring 165 also may have a second end coupled to the closure engagement end 166 of the closure-driven feature 164. The leaf spring 165 extends circumferentially along and radially spaced from the seal ring 122, and may be a circumferentially extending beam of incurvate shape. In any event, the leaf spring 165 biases the closure-driven feature 164 in a radially outward direction (FIG. 6). The projection 124 also may include a pocket 172 in the outer diametric surface thereof to accept a closure internal projection as will be described below.

Figure 9B:
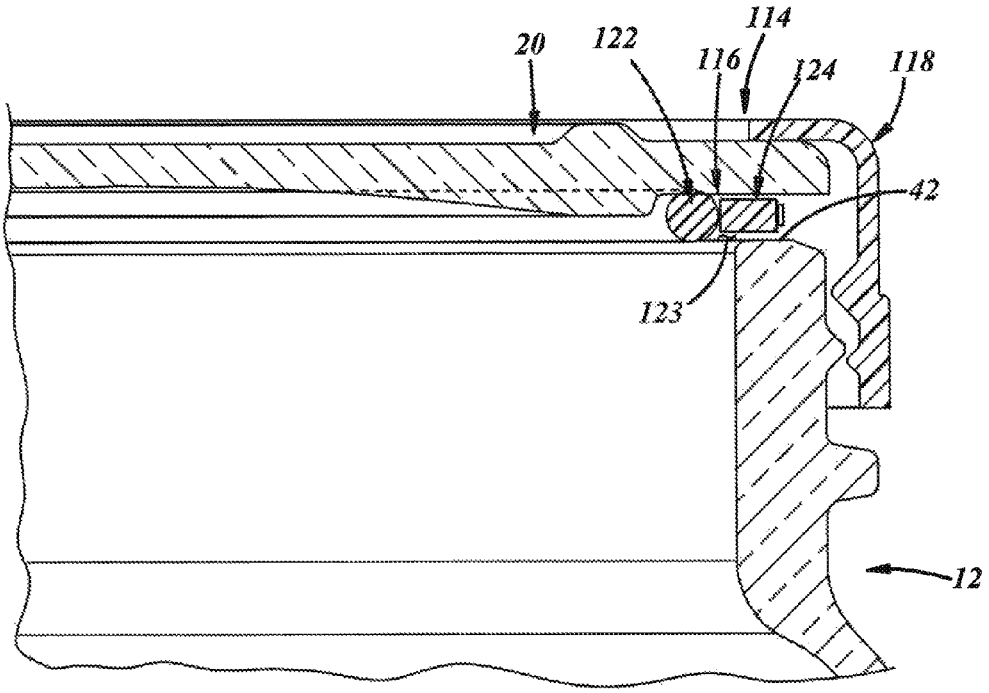
FIG. 9B is a fragmentary, sectional view of the container and seal of FIG. 8 with the closure applied to the container and seal and shown in the vented mode.

With reference to FIGS. 9A and 9B, the seal 116 may be used to seal the closure 114 to the container 12 of the previously described embodiment of FIGS. 1-5. The closure 114 may include the closure base 20 of the previously described embodiment of FIGS. 1-5, and a closure skirt 118 that may be substantially the same as the previously described embodiment of FIGS. 1-5. In this embodiment, however, the closure skirt 118 includes a seal drive feature 168 (FIG. 9A) that may be a lug including a radially inwardly facing surface 170 (FIG. 9A) for cooperation with the closure-driven feature 164 of the projection 124. The surface 170 (FIG. 9A) may be rounded for smooth engagement with the projection feature 164.

The seal drive feature 168 also may cooperate with the carrier pocket 172 (FIG. 8). For example, the seal drive feature 168 may seat in the pocket 172 (FIG. 8) when the closure 114 and the seal 116 are being applied to the container 12. Although only one seal drive feature 168 is illustrated, any suitably quantity may be used.

But when the closure 114 is being removed from the container 12, for example, by rotation of the closure 114 in an unthreading direction, the seal drive feature 168 may be dislodged from the pocket 172 (FIG. 8), and may circumferentially traverse the projection 124 along the closure-driven feature 164. Such movement of the seal drive feature 168 with respect to the projection 124 will displace the closure-driven feature 164 radially inwardly, particularly when the seal drive feature 168 engages the closure engagement end 166 of the closure-driven feature 164.

As a result, and as illustrated in FIGS. 8 and 9A, the closure-driven feature 164 is pushed radially inwardly and, in turn, the closure-driven feature 164 pushes the seal ring 122 radially inwardly and out of sealing engagement with the sealing surface 42 (FIG. 9A) of the container 12 and/or the corresponding wall of the closure base 20 (FIG. 9A). Accordingly, a vacuum release path 123 may be established radially between the seal ring 122 and the container 12.

Figure 10:
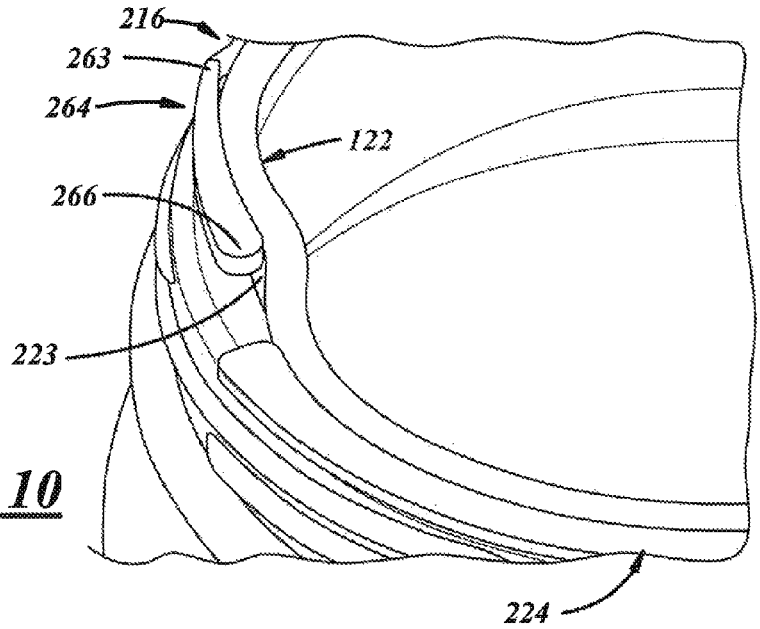
FIG. 10 is a top perspective view of a package in accordance with another illustrative embodiment of the present disclosure, and including a container and a seal illustrated on top of a sealing surface of the container with a closure removed for clarity and in a vented mode.

FIG. 10 shows another illustrative embodiment of a seal 216. This embodiment is similar in many respects to the embodiment of FIGS. 1-9B and like numerals among the embodiments generally designate like or corresponding elements throughout the several views of the drawing figures. Accordingly, the descriptions of the embodiments are incorporated into one another, and description of subject matter common to the embodiments generally may not be repeated here.

FIG. 10 illustrates the seal 216 including the seal ring 122 and a projection 224 coupled to the seal ring 122. Like the seal ring 122, the projection 224 may be an annular carrier or support ring to circumferentially support the seal ring 122, but not necessarily completely circumferentially around the ring 122. In any case, the projection 224 has a radially outer periphery greater in radial dimension than a corresponding radially outer periphery of the seal ring 122.

Like the previous embodiment, the projection 224 may include a closure-driven feature 264, which may be a circumferentially extending beam of excurvate shape. The feature 264 may include a fulcrum end 263 and a closure engagement end 266 circumferentially and radially spaced from the fulcrum end 263. But unlike the previous embodiment, the projection 224 need not include a leaf spring.

Figure 11:
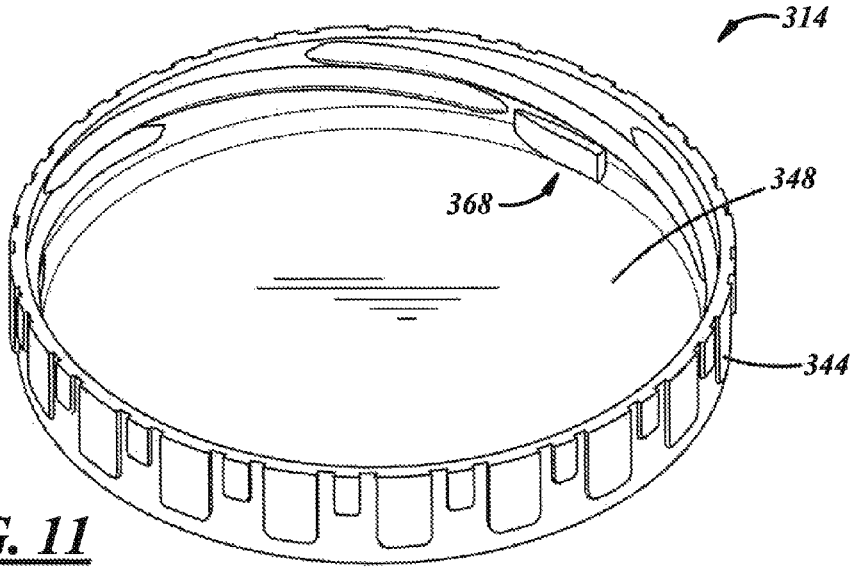
FIG. 11 is a bottom perspective view of the closure of FIG. 10.
Figure 12:
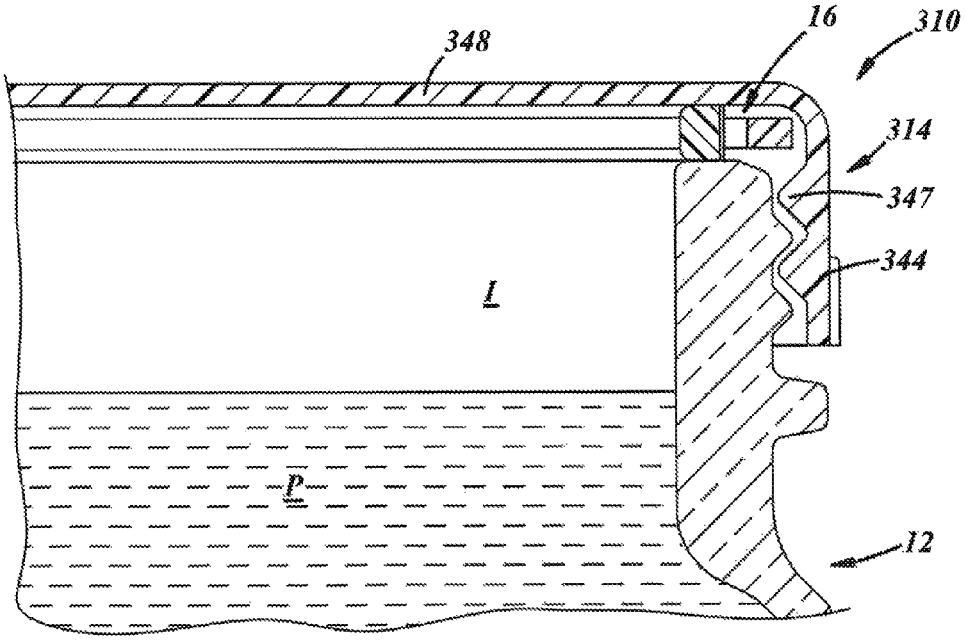
FIG. 12 is a fragmentary, sectional view of the package of FIG. 10.

FIGS. 11 and 12 show another illustrative embodiment of a closure 314 for a package 310 (FIG. 12). This embodiment is similar in many respects to the embodiment of FIGS. 1-10 and like numerals among the embodiments generally designate like or corresponding elements throughout the several views of the drawing figures. Accordingly, the descriptions of the embodiments are incorporated into one another, and description of subject matter common to the embodiments generally may not be repeated here.

With reference to FIG. 11, the closure 314 includes a cylindrical wall 344 and a radially inwardly directed base or base wall 348, at an upper end of the wall 344. The base wall 348 extends completely radially within the wall 344 and, unlike the previous embodiments, the closure 314 does not include a separate base member. Accordingly, the closure 314 is unitary such that the cylindrical wall 344 extends integrally from the closure base wall 348. Also, the closure 314 includes one or more seal drive features 368 extending radially inwardly from the cylindrical wall 344.

With reference to FIG. 12, the seal 16 may be assembled to the closure 314 and retained thereto by a radially inwardly directed projection 347 or bead. Also, the closure 314 carrying the seal 16 may be coupled to the container 12 via threads as shown, or in any other suitable manner. The package 310 may be used to contain a product P in an interior I thereof.

There thus has been disclosed a package that fully satisfies one or more of the objects and aims previously set forth. The disclosure has been presented in conjunction with an exemplary embodiment, and modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A multi-piece seal for sealing engagement between a closure and a container, and including:

an elastomeric seal ring having a sealing portion; and a plastic projection being coupled to the seal ring, extending circumferentially and radially outwardly of the seal ring, and having a closure-driven feature engageable by the closure when the closure is rotated on the container in a loosening direction to unseat the seal ring from sealing engagement between the container and the closure, wherein the seal ring has a longitudinally cross-sectional centroid, and the projection has a longitudinally cross-sectional centroid that is radially outboard of the longitudinally cross-sectional centroid of the seal ring.

2. The seal set forth in claim 1 wherein the sealing portion of the seal ring has an axial height greater than that of a corresponding portion of the projection.

3. The seal set forth in claim 1 wherein the projection is rectangular in longitudinal cross section with projection axial facing surfaces and projection radially facing surfaces that are shorter than the projection axial facing surfaces.

4. The seal set forth in claim 1 wherein the seal ring is circular in longitudinal cross section, and the projection is rectangular in longitudinal cross section.

5. The seal set forth in claim 1, wherein the closure-driven feature is a ratchet feature.

6. The seal set forth in claim 5, wherein the ratchet feature includes a tangentially outwardly facing ramp and a circumferentially facing abutment.

7. The seal set forth in claim 1 in which the projection is a circumferentially and radially outwardly extending cam arm.

8. A seal for sealing engagement between a closure and a container, and including:

a seal ring having a sealing portion; and a projection being coupled to the seal ring, extending circumferentially and radially outwardly of the seal ring, and having a closure-driven feature engageable by the closure when the closure is rotated on the container in a loosening direction to unseat the seal ring from sealing engagement between the container and the closure, wherein the projection is part of a carrier ring disposed radially outwardly of the seal ring and the seal ring is connected to the carrier ring by at least one connection portion.

9. The seal set forth in claim 8 wherein the seal ring has a longitudinally cross-sectional centroid, and the projection has a longitudinally cross-sectional centroid that is radially outboard of the longitudinally cross-sectional centroid of the seal ring.

10. The seal set forth in claim 8 wherein the at least one connection portion includes a plurality of circumferentially spaced apart connection portions of the seal ring, the seal ring having unconnected portions not connected to the carrier ring circumferentially between the connected portions.

11. The seal set forth in claim 10 wherein the seal includes a plurality of gaps extending radially between the seal ring and the carrier ring and circumferentially between the connected portions.

12. A package including:

a container having a neck finish with at least one external closure securement element and an annular axially facing sealing surface;

a closure coupled to the container and including:

a base for covering the container sealing surface; and a cylindrical wall having at least one internal container securement element for engaging the at least one external closure securement element on the container and also having a seal drive feature for driving the closure-driven feature of the projection; and a seal for sealing engagement between the closure and the container, and including:

a seal ring having a sealing portion; and a projection being coupled to the seal ring, extending circumferentially and radially outwardly of the seal ring, and having a closure-driven feature engageable by the closure when the closure is rotated on the container in a loosening direction to unseat the seal ring from sealing engagement between the container and the closure, wherein the closure-driven feature is a ratchet feature, and wherein the seal is sealingly engaged between the sealing surface of the container and the closure base when the closure is secured to the container.

13. The package set forth in claim 12, wherein the projection is part of a carrier ring disposed radially outwardly of the seal ring, and wherein the seal drive feature engages the ratchet feature upon rotation of the closure on the finish in an unthreading direction to rotate the projection so that the rotating carrier ring pulls the connected portions of the seal ring and stretches the unconnected portions of the seal ring out of sealing engagement with at least one of the sealing surface or the closure base.

14. The package set forth in claim 13, wherein the seal drive feature includes a tangentially inwardly facing ramp and a circumferentially facing abutment.

15. The package set forth in claim 12 wherein the seal ring is elastomeric, the projection is plastic, the container is glass, and the closure is a multiple piece closure, wherein the cylindrical wall is plastic and is separate from the base and has a radially inwardly directed flange and a cylindrical wall depending from the flange and having the at least one internal container securement element, and wherein the base is glass and has a circular periphery captured between the flange and the container.

16. A seal for sealing engagement between a closure and a container, and including:

a seal ring having a sealing portion; and a projection being coupled to the seal ring, extending circumferentially and radially outwardly of the seal ring, and having a closure-driven feature engageable by the closure when the closure is rotated on the container in a loosening direction to unseat the seal ring from sealing engagement between the container and the closure, wherein the projection is a circumferentially and radially outwardly extending cam arm that includes a fulcrum end, extends circumferentially along and radially away from the seal ring, and includes a closure engagement end circumferentially and radially spaced from the fulcrum end.

17. The seal set forth in claim 16, wherein the projection also includes a leaf spring having a first end, extends circumferentially along and radially spaced from the seal ring, and includes a second end coupled to the closure engagement end of the cam arm.

18. A package including:

a container having a neck finish with at least one external closure securement element and an annular axially facing sealing surface;

a closure coupled to the container and including:

a base for covering the container sealing surface; and a cylindrical wall having at least one internal container securement element for engaging the at least one external closure securement element on the container and also having a seal drive feature for driving the closure-driven feature of the projection; and a seal for sealing engagement between the closure and the container, and including:

a seal ring having a sealing portion; and a projection being coupled to the seal ring, extending circumferentially and radially outwardly of the seal ring, and having a closure-driven feature engageable by the closure when the closure is rotated on the container in a loosening direction to unseat the seal ring from sealing engagement between the container and the closure, wherein the projection is a circumferentially and radially outwardly extending cam arm, and wherein the seal is sealingly engaged between the sealing surface of the container and the closure base when the closure is secured to the container.

19. The package set forth in claim 18, wherein the seal drive feature engages the closure-driven feature upon rotation of the closure on the finish in the unthreading direction to push the projection and the seal ring radially inwardly out of sealing engagement with at least one of the sealing surface or the base wall.

20. The package set forth in claim 19, wherein the seal drive feature includes a radially inwardly facing surface.

21. The package set forth in claim 18 wherein the seal ring is elastomeric, the projection is plastic, the container is glass, and the closure is a multiple piece closure, wherein the cylindrical wall is plastic and is separate from the base and has a radially inwardly directed flange and a cylindrical wall depending from the flange and having at least one internal container securement element for removable threaded securement to the finish, and wherein the base is glass or plastic and has a circular periphery captured between the flange and the container.

22. The package set forth in claim 18 wherein the closure is unitary such that the cylindrical wall extends integrally from the closure base, and the closure base extends completely radially inwardly from the cylindrical wall.

23. A closure and a container package that includes:

a container having a finish with at least one closure securement element and an annular axially facing sealing surface, a closure that includes a base and a cylindrical wall and at least one container securement element on said cylindrical wall for engaging said at least one closure securement element on said finish, and an annular seal ring disposed between said base and said sealing surface for sealing engagement with said base and said sealing surface upon threaded tightening of said closure onto said finish, characterized in that an annular support ring is disposed adjacent to said seal ring, said support ring having a circumferentially facing closure abutment, and said closure includes an internal lug to engage said closure abutment on said support ring upon rotation of said closure on said finish in an unthreading direction to rotate said support ring and stretch portions of said seal ring out of sealing engagement with said sealing surface and/or said base.

24. The package set forth in claim 23 in which said closure includes an annular closure ring having said cylindrical wall and a closure plate captured by said closure ring such that an internal surface of said plate forms said base.

25. The package set forth in claim 23 in which the seal ring is connected to the annular support ring at a plurality of circumferentially spaced apart connected portions of the seal ring, the seal ring having unconnected portions not connected to the annular support ring circumferentially between the connected portions, and the closure-driven feature is a ratchet feature and the closure internal projection projects from said base and/or said cylindrical wall to engage the ratchet feature upon rotation of the closure on the finish in an unthreading direction to rotate the annular support ring so that the annular support ring pulls the connected portions of the seal ring and stretches the unconnected portions of the seal ring out of sealing engagement with at least one of the sealing surface or the base.

26. A closure and a container package that includes:

a container having a finish with at least one closure securement element and an annular axially facing sealing surface, a closure that includes a base and a cylindrical wall and at least one container securement element on said cylindrical wall for engaging said at least one closure securement element on said finish, and an annular seal ring disposed between said base and said sealing surface for sealing engagement with said base and said sealing surface upon threaded tightening of said closure onto said finish, characterized in that an annular support ring is disposed adjacent to said seal ring, said support ring having a radially outwardly facing cam, and said closure includes an internal lug to engage said cam on said support ring upon rotation of said closure on said finish in an unthreading direction to push said cam and said seal ring radially inwardly out of sealing engagement with said sealing surface and/or said base.

27. The package set forth in claim 26 in which said closure includes an annular closure ring having said cylindrical wall and a closure plate captured by said closure ring such that an internal surface of said plate forms said base.

28. The package set forth in claim 26 in which the cam includes a fulcrum end, extends circumferentially along and radially away from the seal ring, and includes a closure engagement end circumferentially spaced from the fulcrum end, and the lug projects from at least one of said base or said cylindrical wall and includes a radially inwardly facing surface.

29. A package seal to seal between a closure and a container, and comprising:

an elastomeric seal ring having a sealing portion; and a plastic carrier ring coupled to the seal ring and including a projection disposed radially outwardly of the seal ring and having at least one of a cam follower or a ratchet feature, wherein the seal ring is connected to the carrier ring by at least one connection portion that includes a plurality of circumferentially spaced apart connection portions of the seal ring, the seal ring having unconnected portions not connected to the carrier ring circumferentially between the connected portions, and wherein the seal includes a plurality of gaps extending radially between the seal ring and the carrier ring and circumferentially between the conntected portions.

30. The seal set forth in claim 29 wherein the seal ring has a longitudinally cross-sectional centroid, and the projection has a longitudinally cross-sectional centroid that is radially outboard of the longitudinally cross-sectional centroid of the seal ring.

31. The seal set forth in claim 29 wherein the sealing portion of the seal ring has an axial height greater than that of a corresponding portion of the projection.

32. The seal set forth in claim 29 wherein the projection is rectangular in longitudinal cross section with projection axial facing surfaces and projection radially facing surfaces that are shorter than the projection axial facing surfaces, wherein the seal ring is circular in longitudinal cross section, and the projection is rectangular in longitudinal cross section.

33. A package seal to seal between a closure and a container, and comprising:

an elastomeric seal ring having a sealing portion; and a plastic carrier ring coupled to the seal ring and including a projection disposed radially outwardly of the seal ring and having at least one of a cam follower or a ratchet feature, wherein the ratchet feature includes a tangentially outwardly facing ramp and a circumferentially facing abutment and wherein the cam follower includes a fulcrum end, extends circumferentially along and radially away from the seal ring, and includes a closure engagement end circumferentially and radially spaced from the fulcrum end.

34. The seal set forth in claim 33 wherein the seal ring is connected to the carrier ring by at least one connection portion that includes a plurality of circumferentially spaced apart connection portions of the seal ring, the seal ring having unconnected portions not connected to the carrier ring circumferentially between the connected portions, and wherein the seal includes a plurality of gaps extending radially between the seal ring and the carrier ring and circumferentially between the connected portions.

* * * * *